US010835068B2

(12) United States Patent
Nejeschleba

(10) Patent No.: US 10,835,068 B2
(45) Date of Patent: Nov. 17, 2020

(54) SLIP-RESISTANT MULTIPURPOSE WARDROBE HANGER

(71) Applicant: Julia Nejeschleba, Jacksonville, NC (US)

(72) Inventor: Julia Nejeschleba, Jacksonville, NC (US)

( * ) Notice: Subject to any disclaimer, the term of this patent is extended or adjusted under 35 U.S.C. 154(b) by 0 days.

(21) Appl. No.: 15/967,692

(22) Filed: May 1, 2018

(65) Prior Publication Data

US 2019/0335932 A1 Nov. 7, 2019

(51) Int. Cl.
*A47G 25/16* (2006.01)
*A47G 25/36* (2006.01)
*A47G 25/30* (2006.01)

(52) U.S. Cl.
CPC ..... *A47G 25/16* (2013.01); *A47G 25/30* (2013.01); *A47G 25/36* (2013.01)

(58) Field of Classification Search
CPC ..... A47G 25/16; A47G 25/30; A47G 25/36; A47G 25/486
USPC ..... 223/88, 93
See application file for complete search history.

(56) References Cited

U.S. PATENT DOCUMENTS 1,689,126 A * 10/1928 Gass ..... A47G 25/24 223/88
1,888,137 A * 11/1932 Molner ..... A47G 25/486 223/93
1,969,896 A * 8/1934 Maw ..... A47G 25/24 223/93
2,008,604 A * 7/1935 Troutman ..... A47G 25/486 223/93
2,129,871 A * 9/1938 Reed ..... A47G 25/24 223/88
D128,789 S * 8/1941 Rhodes ..... 223/88
2,279,777 A 4/1942 Dean
2,492,226 A * 12/1949 Kohl ..... A47G 25/743 211/113
2,620,103 A * 12/1952 Antolini ..... A47G 25/486 223/88
2,622,742 A 12/1952 Oldham
2,723,787 A * 11/1955 Bransdorf ..... A47G 25/486 223/93
2,828,056 A * 3/1958 Bennett ..... A47G 25/28 223/93
2,912,149 A 11/1959 Stuward
3,140,024 A * 7/1964 Burns ..... A47G 25/16 223/93
3,168,970 A 2/1965 Wilson
4,606,482 A 8/1986 McHugh
D289,829 S * 5/1987 Klemetsrud ..... D6/319
4,966,287 A * 10/1990 Snyder ..... A45C 11/16 211/113

(Continued)

*Primary Examiner* — Nathan E Durham
(74) *Attorney, Agent, or Firm* — NCCU IP Clinic; De'Von Carter

(57) ABSTRACT

A non-slip multipurpose wardrobe hanger includes a continuous solid frame comprising an interior body; a neck; an upper hook extending from the neck, wherein the neck extends to a pair of opposing arms, wherein each of the opposing arm has a proximal and distal end; two medially positioned cutout sections spanning the length of the opposing arms, wherein each of the cutout section comprises a top and bottom surface; and a non-slip material, wherein the non-slip material is fixedly attached to the bottom surface and top surface of each.

1 Claim, 4 Drawing Sheets

(56) References Cited

U.S. PATENT DOCUMENTS

| | | | | |
|---|---|---|---|---|
| 5,427,230 | A | 6/1995 | Mattox | |
| 5,526,968 | A * | 6/1996 | Larson | A47G 25/1407 116/323 |
| 5,535,927 | A | 7/1996 | Garrison | |
| 6,481,603 | B2 | 11/2002 | Gish | |
| 6,808,064 | B1 * | 10/2004 | Fanning | A47G 25/743 206/286 |
| 7,182,231 | B1 * | 2/2007 | Greiner | A47G 25/30 223/85 |
| 7,377,409 | B1 * | 5/2008 | Brown | A47G 25/16 211/85.2 |
| 9,380,903 | B2 | 7/2016 | Lewis | |
| 2008/0296324 | A1 * | 12/2008 | Zhao | A47G 25/48 223/93 |

* cited by examiner

SLIP-RESISTANT MULTIPURPOSE WARDROBE HANGER

FIELD OF THE INVENTION

The present invention is directed to a slip-resistant multipurpose wardrobe hanger that allows a user to organize an entire outfit on the hanger. More particularly, this invention relates to hangers or garment holders that are designed to hold multiple items. Furthermore, this invention is directed to hangers and garment holders with integrated slip-resistant components.

BACKGROUND OF THE INVENTION

The following description is not an admission that any of the information provided herein is prior art or relevant to the present invention, or that any publication specifically or implicitly referenced is prior art. Any publications cited in this description are incorporated by reference herein. Where a definition or use of a term in an incorporated reference is inconsistent or contrary to the definition of that term provided herein, the definition of that term provided herein applies and the definition of that term in the reference does not apply. Hangers are well known in the prior art; many hangers in the art address the need for hanging multiple items (see, for example, U.S. Pat. Nos. 9,380,903B2; 2,622,742A; and 5,427,230A). Other hangers are slip-resistant (see, for example, U.S. Pat. Nos. 2,912,149A; 6,481,603B2; and 5,535,927A). However, many of these hangers are not capable of both organizing an entire outfit, including jewelry and accessories, while preventing the slipping of items on the hanger.

Thus, there exists a need for an improved non-slip and multipurpose hanger. There also is a need for a multipurpose hanger for clothing, jewelry or other items, which also maximizes closet space.

SUMMARY OF THE INVENTION

Therefore, it is an object of the invention to provide an improved hanger. Another object of the invention is to provide an improved multipurpose wardrobe hanger. Another object of the invention is to provide a hanger with improved slip-resistant properties. Another object of the invention is to provide an improved hanger for clothing, jewelry or other items, which may be hung on or fed through various cutouts and slots, or draped over the neck of the hanger. It is another object of the invention to provide an improved multipurpose wardrobe hanger that maximizes space to be used for the storage of items hung within a closet. These and other objects of the present invention are achieved in the embodiments disclosed below by providing a multipurpose wardrobe hanger.

In one embodiment, the non-slip multipurpose wardrobe hanger comprises a continuous solid frame comprising an interior body, a neck, an upper hook extending from the neck, wherein the neck extends to a pair of opposing arms. In this embodiment, each opposing arm includes a proximal and distal end, two medially positioned cutout sections spanning the length of opposing arms, wherein each of cutout sections comprises a top and bottom surface, and a non-slip material, wherein the non-slip material is fixedly attached to the bottom surface and top surface of each cutout section.

In yet another embodiment, the non-slip material comprises foam, rubber or vinyl and non-slip material spans about the entire length of each of the cutout section, and wherein the non-slip material is fixedly attached to cutout sections by glue, double-sided tape, or hook and loop tape.

In still another embodiment, the non-slip material spans a fraction of the length of each of cutout sections.

In yet another embodiment, the non-slip material spans about 2 inches of the length of each of cutout sections.

In a further embodiment, the neck comprises a plurality of holes.

In yet another embodiment, the plurality of holes are about 1 mm in diameter to about 4 mm in diameter. And the neck comprises four holes 1 mm in diameter evenly placed ¼ inch to about 1 inch below neck.

In a further embodiment, the interior body comprises a plurality of accessory slots, and accessory slots are evenly apart from each other.

In yet another embodiment, the interior body comprises three accessory slots, and accessory slots are each about ¼ inch to about ½ inch high, and about 3½ inches to about 4 inches wide, and accessory slots are located about ¼ inch apart from each other.

In another embodiment, the accessory slots are configured to hold undergarments, scarves, belts, ascots, necklaces, or wraps.

In yet another embodiment, the interior body comprises a bottom slot positioned between the distal ends of the arms, and the bottom slot is configured to hold pants, or wide wraps within.

In still another embodiment, the bottom slot is about ½ inch to about ¾ inch high, and about 8 inches to about 15 inches wide.

In an alternative embodiment, the non-slip multipurpose wardrobe hanger comprises a continuous solid frame comprising an interior body comprising a plurality of accessory slots, wherein accessory slots are evenly apart from each other, a neck comprising a plurality of holes, and an upper hook extending from neck. The neck extends to a pair of opposing arms, and each of opposing arm has a proximal and distal end, plus two medially positioned cutout sections spanning the length of opposing arms, wherein each of the cutout sections comprises a top and bottom surface, and a non-slip material comprising foam, rubber or vinyl and non-slip material spans about the entire length of each of cutout section, and the non-slip material is fixedly attached to the cutout sections by glue, double-sided tape, or hook and loop tape.

In yet another embodiment, the neck comprises a plurality of holes of about 1 mm in diameter to about 4 mm in diameter.

In one embodiment, the interior body comprises three accessory slots, and accessory slots are each about ¼ inch to about ½ inch high, and about 3½ inches to about 4 inches wide, and accessory slots are located about ¼ inch apart from each other.

In still another embodiment, the interior body comprises a bottom slot positioned between the distal ends of the arms, and the bottom slot is configured to hold pants, or wide wraps within.

In yet another exemplary embodiment, the non-slip multipurpose wardrobe hanger comprises a continuous solid frame comprising an interior body, wherein the interior body comprises three accessory slots, wherein the accessory slots are each about ¼ inch to about ½ inch high, and about 3½ inches to about 4 inches wide. The accessory slots are located about ¼ inch apart from each other. And a neck comprising four holes 1 mm in diameter evenly placed ¼ inch to about 1 inch below the neck, an upper hook extending from the neck. The neck extends into a pair of opposing arms, wherein each of opposing arm having a proximal and distal end, two medially positioned cutout sections spanning the length of opposing arms, wherein each of cutout sections comprises a top and bottom surface, and a non-slip material, and the non-slip material is fixedly attached to the bottom surface and top surface of each cutout sections. And the interior body further comprises a bottom slot positioned between the distal ends of the arms, and wherein the bottom slot is configured to hold pants, or wide wraps within.

In one embodiment, the bottom slot is about ½ inch to about ¾ inch high, and about 8 inches to about 15 inches wide.

In a further embodiment, the accessory slots are configured to hold undergarments, scarves, belts, ascots, necklaces, or wraps.

In yet another embodiment, the non-slip material comprises foam, rubber or vinyl and non-slip material spans about 2 inches of the length of each cutout section, and the non-slip material is fixedly attached to the cutout sections by glue, double-sided tape, or hook and loop tape.

BRIEF DESCRIPTION OF THE DRAWINGS

Some of the items of the invention have been set forth above. Other objects and advantages of the invention will appear as the invention proceeds when taken in conjunction with the following drawings.

DETAILED DESCRIPTION

As used herein, and unless the context dictates otherwise, the term "slip-resistant multipurpose hanger," "slip-resistant multipurpose wardrobe hanger," "multi-purpose wardrobe hanger," "multipurpose hanger," and "hanger" may be used interchangeably.

As used herein, the term "about" in conjunction with a numeral refers to a range of that numeral starting from 10% below the absolute of the number to 10% above the absolute of the numeral, inclusive.

Figure 1:
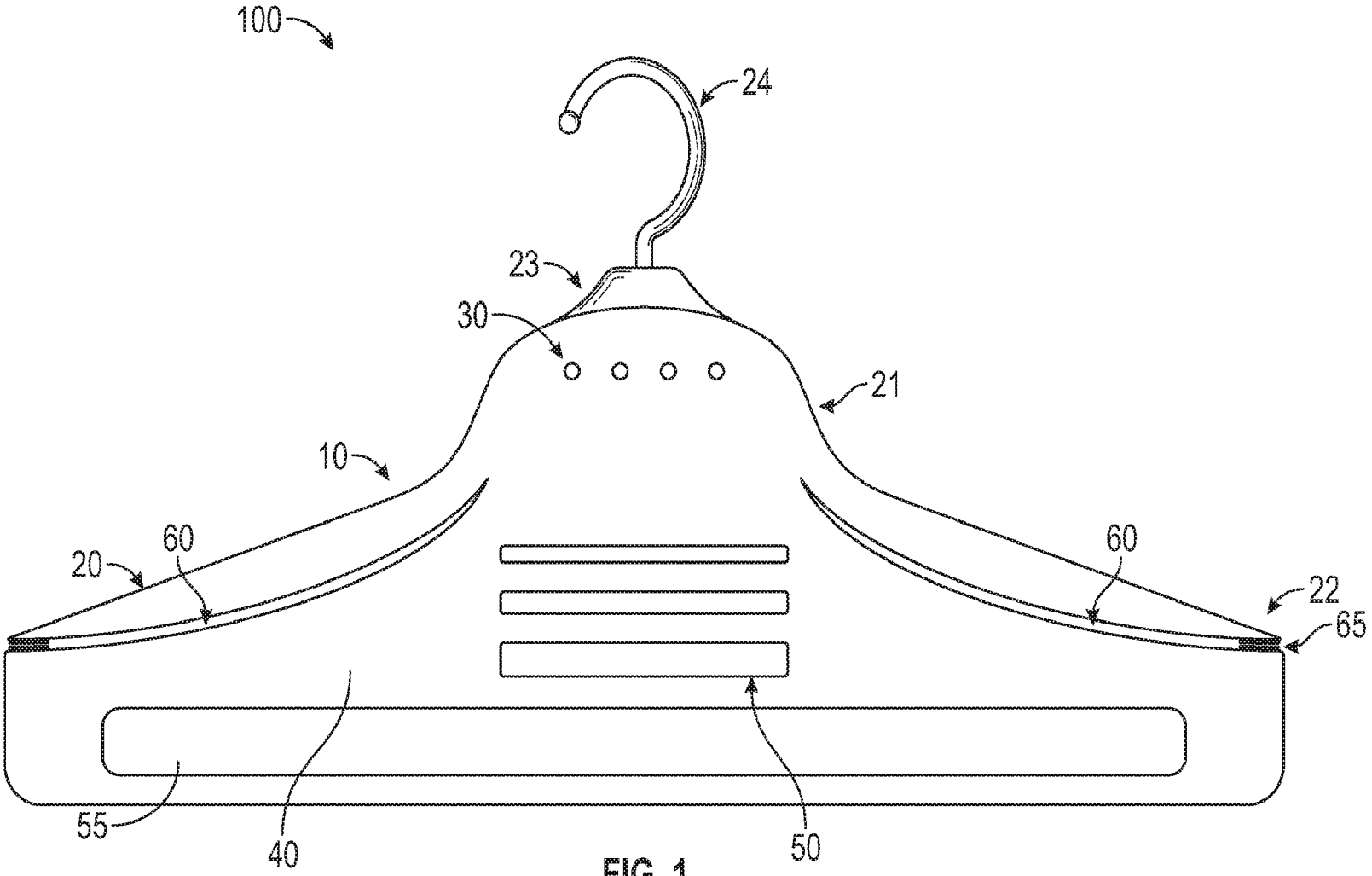
FIG. 1 is an exemplary configuration of the front view of a slip-resistant multipurpose wardrobe hanger according to the present invention.

An exemplary configuration is schematically depicted in FIG. 1, in which a slip-resistant multipurpose wardrobe hanger 100 is designed to accommodate or organize an entire garment while also preventing slippage of any accessories, clothing, or items from hanger 100. Multipurpose hanger 100 comprises a continuous solid frame 10 with an interior body 40, upper hook 24 extending from neck 23 which extends to a pair of opposing arms 20, each having a proximal end 21 and distal end 22; two medially positioned cutout sections 60 spanning the length of opposing arms 20, wherein each cutout section 60 comprises a top surface 61 and bottom surface 62 (see FIG. 2) and is fitted with non-slip material 65. In one embodiment, cutout sections 60 are tapered toward proximal ends 21 of opposing arms 20 (see FIG. 1). In an embodiment, cutout sections 60 are designed to prevent slippage of garment. In yet another embodiment cutout sections 60 are not tapered (not shown). In an embodiment, neck 23 includes a plurality of holes 30. In one embodiment, plurality of holes 30 comprise 4 holes about 1 mm in diameter evenly placed about ¼ inch to about 1 inch below neck 23. In one embodiment, plurality of holes 30 are about 1 mm in diameter to about 4 mm in diameter. In another embodiment, plurality of holes 30 are configured to hold small items such as cufflinks, a necklace, a broach, pins, earrings, or the like. In another embodiment, plurality of holes 30 comprise 2 holes about 2 mm in diameter. In yet another embodiment, plurality of holes 30 comprise 2 holes about 1 mm in diameter and 2 holes about 2 mm in diameter. One of ordinary skill in the art will readily appreciate plurality of holes 30 of different size and shapes to accommodate any type of accessory, and such variation in hole sizes are also within the scope of the invention.

In an exemplary embodiment, interior body 40 comprises a plurality of accessory slots 50 (see FIG. 1). In another exemplary embodiment, interior body 40 comprises three accessory slots 50, wherein accessory slots 50 are each about ¼ inch to about ½ inch high, and about 3½ inches to about 4 inches wide, wherein accessory slots 50 are located about ¼ inch apart from each other. In another exemplary embodiment, accessory slots 50 are evenly apart from each other. Accessory slots 50 are configured to hold accessories which include, but are not limited to, undergarments, scarves, belts, ascots, necklaces, wraps, and the like. In one embodiment, interior body 40 comprises bottom slot 55 positioned between distal ends 22 of arms 20, which is configured to hold a garment including, but not limited to, pants, or wide wraps within. In one embodiment, bottom slot 55 is about ½ inch to about ¾ inch high and about 8 inches to about 15 inches wide. A skilled person in the art will be readily able to select appropriate dimensions for bottom slot 55 to accommodate garments of different sizes and shapes.

Figure 2:
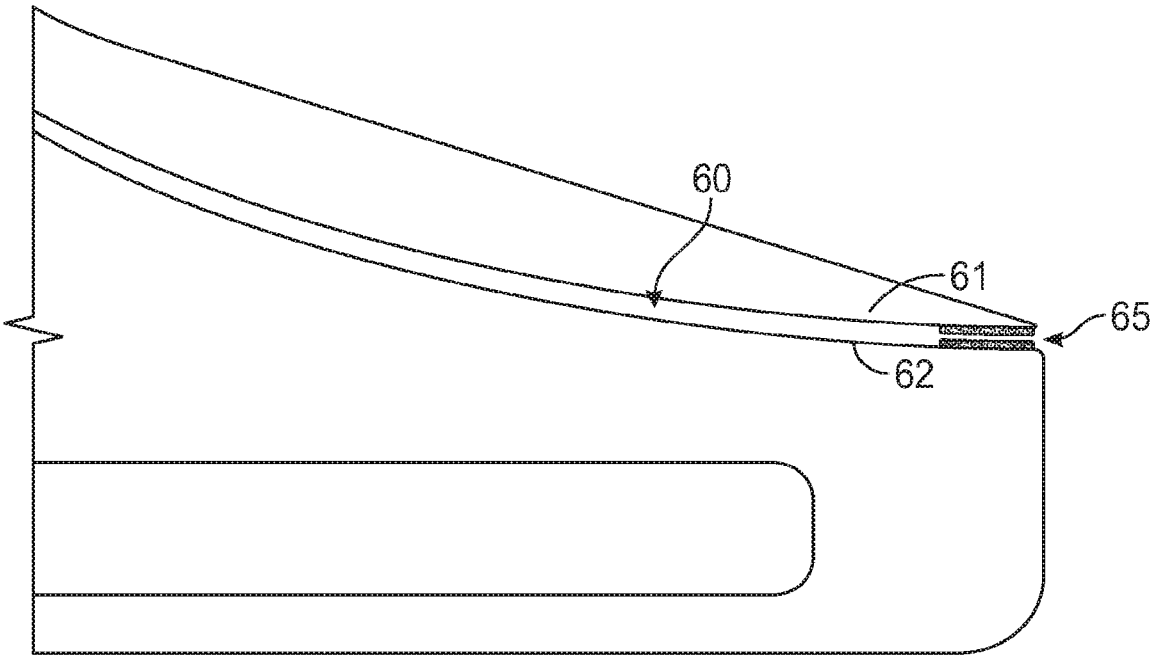
FIG. 2 is an exemplary configuration of the close-up view of the non-slip cutout section according to the present invention.

In an embodiment, cutout sections 60 are fitted with a non-slip material 65 such as foam, rubber or vinyl fixedly attached to bottom surface 62 and top surface 61 of each cutout section 60 (see FIGS. 1 and 2). In one embodiment, non-slip material 65 spans about the entire length of each cutout section 60. In another embodiment, non-slip material 65 spans a fraction of the length of each cutout section 60 (see FIGS. 1 and 2). In yet another embodiment, the non-slip material 65 spans about 2 inches of the length of each cutout section 60 (not shown).

Means of attachment of non-slip material 65 to bottom surface 62 and top surface 61 include, but are not limited to, glue, double-sided tape, hook and loop tape, other liquid adhesive, and the like. In one embodiment, upper hook 24 is fixedly attached to hanger 100 by a screw. In another embodiment upper hook 24 has a threaded end at its bottom portion for screwing directly into neck 23.

In one embodiment, the material of construction for frame 10 is composite plastic, wood, stainless steel, aluminum, or any combination thereof, and is selected based on the usage. For example, in an embodiment, the material can be wood for hanging heavier garments such as coats and suits. In another embodiment, frame 10 comprises plastic for hanging lighter garments such as blouses and pants. A skilled person in the art will be readily able to select a suitable material of construction for frame 10 and the non-slip material based on the usage and types of the garment. The material of construction for upper hook 24 is metal such as stainless steel, aluminum, or any combination thereof.

Figure 3:
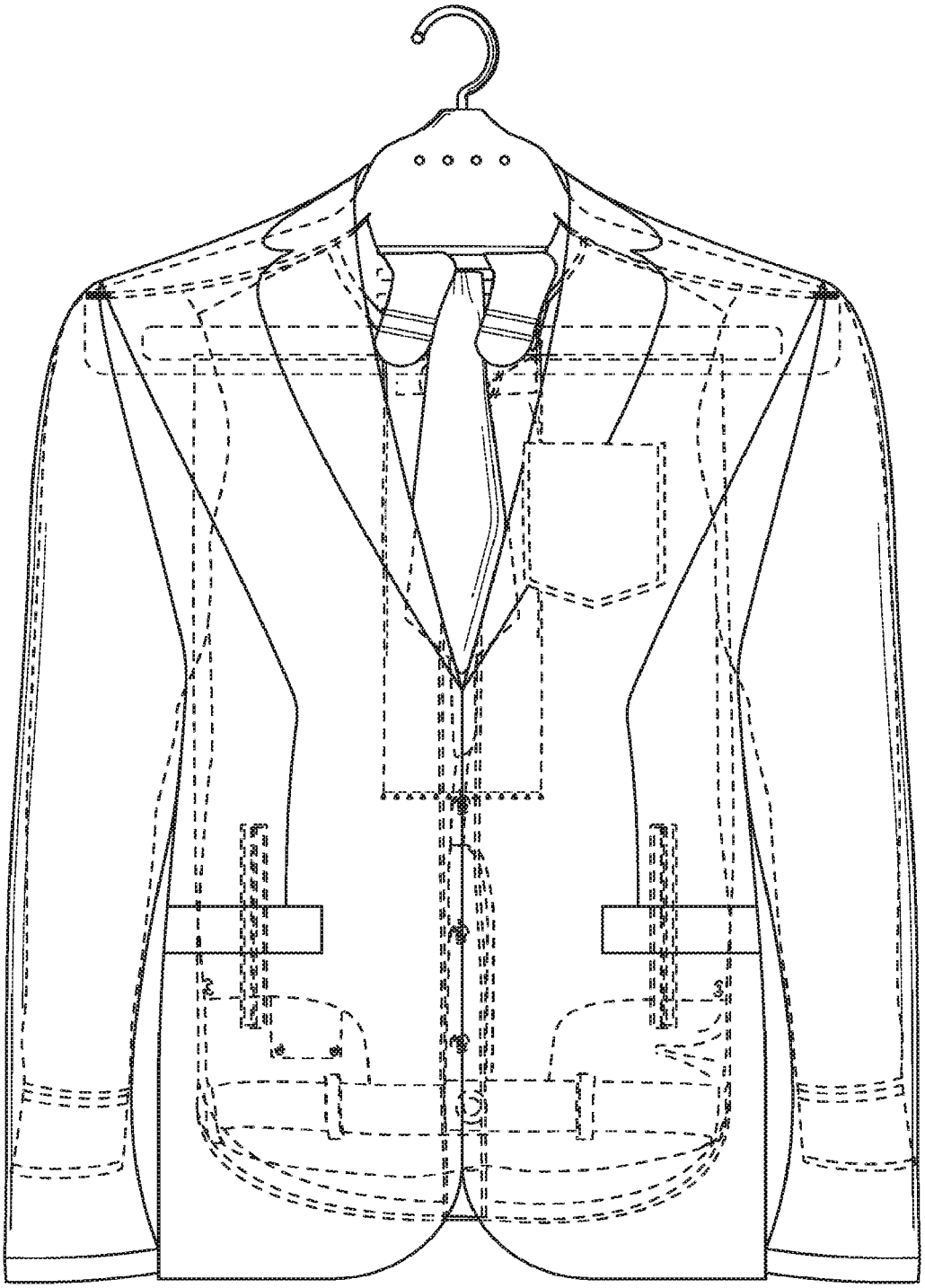
FIG. 3 is an exemplary configuration of the front view of a slip-resistant multipurpose wardrobe hanger in engagement with multiple wardrobe items.
Figure 4:
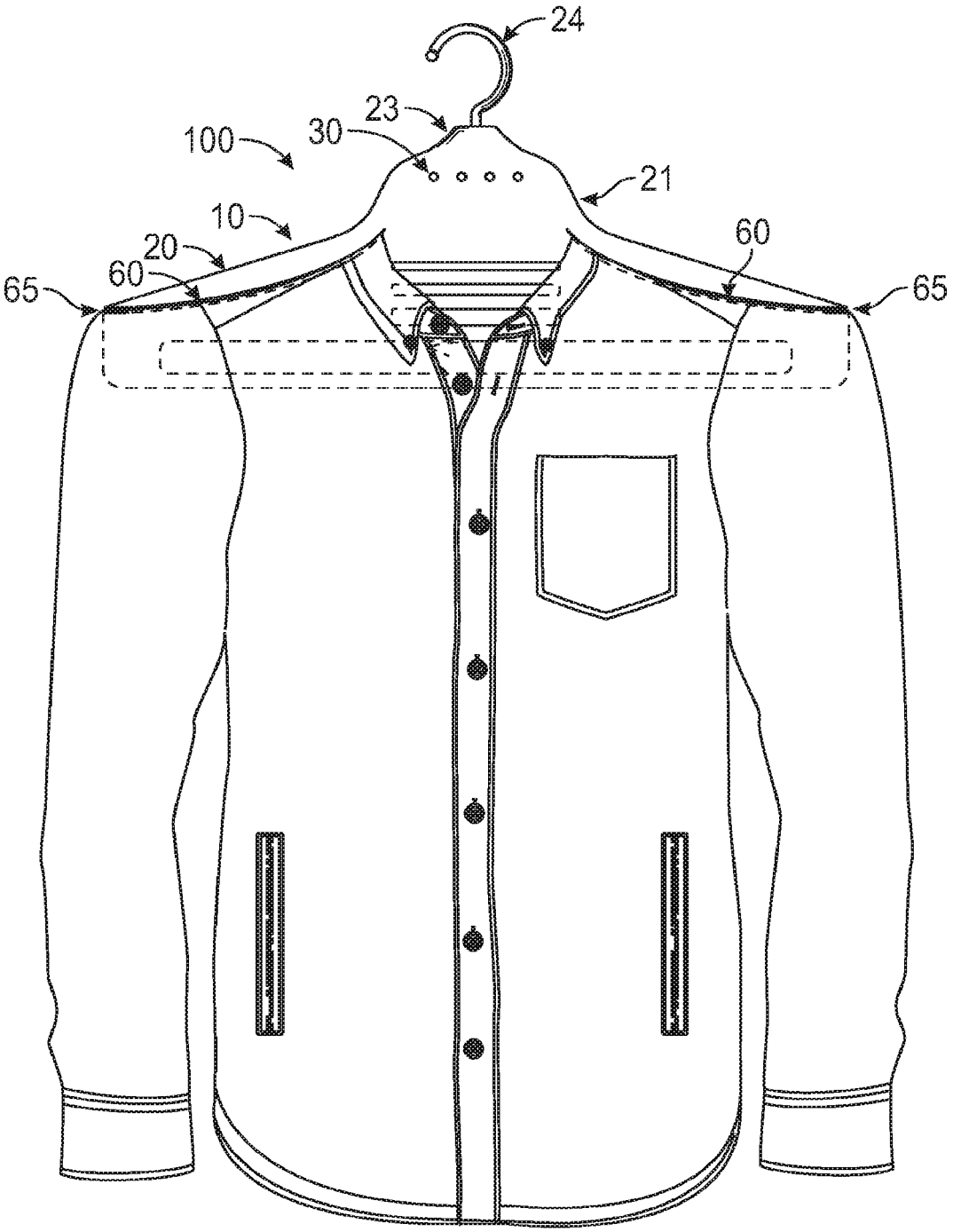
FIG. 4 is an exemplary configuration of the front view of a slip-resistant multipurpose wardrobe hanger depicting the use of the non-slip feature.

As shown in FIG. 3, multipurpose hanger 100 is configured to simultaneously hold a variety of items. As shown in FIG. 4, Hanger 100 is configured to receive and retain a garment by engaging cutout sections 60. A user slips the garment through cutout sections 60, wherein the friction due to the tight space between top and bottom surface 61 and 62 fitted with non-slip material 65, respectively, of each cutout section 60 engages the garment and retains it in place on hanger 100.

Thus, specific embodiments of slip-resistant multipurpose wardrobe hanger have been disclosed. it should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

The invention claimed is:

1. A non-slip multipurpose wardrobe hanger consisting of:

i) a continuous solid frame comprising an interior body;

ii) a neck;

iii) an upper hook extending from said neck, wherein said neck extends to a pair of opposing arms, wherein each of said opposing arms comprises a proximal and distal end;

iv) two medially positioned cutout sections wherein each said cutout section spans the length of a respective opposing arm of said pair of said opposing arms, wherein each of said cutout sections comprises a top and bottom surface; and v) a non-slip material, wherein said non-slip material is fixedly attached to said bottom surface and top surface of each said cutout section;

wherein each said cutout section comprises a tapered end at said proximal end of each said opposing arm;

wherein said interior body comprises a bottom slot positioned between said distal ends of said arms, wherein said bottom slot is configured to hold pants, or wide wraps within;

wherein said tapered end is configured to hold a garment secured; wherein said neck comprises a plurality of holes; wherein said interior body comprises a plurality of accessory slots; and wherein said accessory slots are spaced evenly apart from each other.

* * * * *